US005237543A

United States Patent [19]

Erickson et al.

[11] Patent Number: 5,237,543

[45] Date of Patent: Aug. 17, 1993

[54] MOMENT BENDER TRANSDUCER DRIVE

[75] Inventors: David J. Erickson, Liverpool; Robert T. Winnicki, Marcellus; Louis M. Izzo, Fayetteville, all of N.Y.

[73] Assignee: General Electric Company, Syracuse, N.Y.

[21] Appl. No.: 870,733

[22] Filed: Apr. 16, 1992

Related U.S. Application Data

[63] Continuation of Ser. No. 633,142, Dec. 24, 1990, abandoned.

[51] Int. Cl.[5] ..... H04V 17/00

[52] U.S. Cl. ..... 367/157; 367/163; 367/174; 367/159; 310/348; 310/337

[58] Field of Search ..... 367/157, 163, 167, 172, 367/174, 159; 310/348, 337

[56] References Cited

U.S. PATENT DOCUMENTS

| | | | |
|---|---|---|---|
| 3,258,738 | 6/1966 | Merchant | 367/158 |
| 3,274,537 | 9/1966 | Toulis | 340/8 |
| 3,538,494 | 11/1970 | Erickson | 340/12 |
| 3,972,018 | 7/1976 | Erickson | 340/10 |
| 4,420,826 | 12/1983 | Marshall, Jr. et al. | 367/172 |
| 4,731,764 | 3/1988 | Ponchaud | 367/158 |
| 4,742,499 | 5/1988 | Butler | 367/155 |
| 4,754,441 | 6/1988 | Butler | 367/157 |
| 4,764,907 | 8/1988 | Dahlstrom et al. | 367/163 |
| 4,972,390 | 11/1990 | Pagliarini, Jr. | 367/158 |

OTHER PUBLICATIONS

Daniel W. Martin, "Review of Acoustical Patents", J. Acoust. Soc. Am. 90(5), Nov. 1991, p. 2874.

D. L. Hutchins, Low-Frequency Sonar Projectors, Fall 1978, "Scientific Honeyweller", pp. 96-103.

R. S. Wollett, Basic Problems Caused by Depth and Size Constraints in Low-Frequency Underwater Transducers, Oct. 1980, "J. Acoust. Soc. Am. 68(4)", pp. 1031-1035.

G. Brigham and B. Glass, Present Status in Flextensional Transducer Technology, Oct. 1980, "J. Acoust. Soc. Am., vol. 68, No. 4".

R. S. Woollett, Theory of the Piezoelectric Flexural Disk Transducer with Applications to Underwater Sound, 5 Dec. 1960, "USL Research Report No. 490 S-F001 03 04-1", pp. Title Page, Summary Page, Abstract (iii-xi); pp. 1-77.

*Primary Examiner*—J. Woodrow Eldred

*Attorney, Agent, or Firm*—Paul Checkovich; Stephen A. Young

[57] ABSTRACT

A transducer includes an acoustic radiating member for generating acoustic energy in a transmitting medium and a driver member that is pivotally connected to the radiating member. The driver member is for urging movement of the radiating member, wherein such movement generates the energy. Pivoting of the driver member with respect to the radiating member relieves predetermined stress in the driver member. The radiating member may include, for example, a flat element such as a bar, plate or disk, or an I-shaped element. The driver element may include an electroactive material. The driver element may be connected to the radiating element by support apparatus that is fixedly coupled to the radiating element includes a screw having a predeterminedly contoured end that engages a complimentarily contoured recess connected to the driver element for permitting the pivoting. When the support apparatus includes a screw it may be adjusted for supplying a predetermined force on the driver element.

34 Claims, 6 Drawing Sheets

MOMENT BENDER TRANSDUCER DRIVE

This application is a continuation of application Ser. No. 07/633,142, filed Dec. 24, 1990, now abandoned.

BACKGROUND OF THE INVENTION

The present invention relates to apparatus and method for generating acoustic energy, and, more particularly, to apparatus and method for generating such energy wherein excitation, or driver, means are not part of, and are not rigidly connected to, acoustic radiating means, so that flexing of the excitation means is substantially reduced and/or eliminated.

As used herein, a transducer is a device capable of being actuated by generating waves from one or more transmission systems or media, and of supplying related generated waves in response thereto to one or more other transmission systems or media. A specific example of such a device is one which receives electrical waves (generating waves) and produces acoustic waves (generated waves) which may be injected into a transmitting medium such as air or water. An audio speaker is an example of such transducer using air as a transmitting medium and a sonar transducer is an example of use with a water medium. The present invention will be described as it may be used with water as a transmitting medium, it being understood that the invention is not limited by the type of transmitting medium used.

In order to create an acoustic wave in a transmitting medium, it is necessary that a portion of the transmitting medium be physically moved. The amount or volume of the transmitting medium moved by the acoustic radiating means per unit time will determine the power of the generated wave, and the rate of a pulsing or oscillation of the acoustic radiating means that imparts such movement will determine the frequency of the generated wave.

In the category of known sonar transducers, there is a group of such transducers that generate acoustic energy by flexure of the acoustic radiating member, which commonly is arranged as a bar or disk that includes the electroactive material, such as a piezoelectric ceramic, used to form the electroactive driver for the radiating member. Thus, for the flexural class of transducers, the acoustic radiating member and the electroactive driver constitute the same element, and the driver is subjected to bending stresses. A representative flexural transducer is shown in the middle figure on page 101 of an article entitled "Low Frequency Sonar Projectors"—Hutchins from *Scientific Honeyweller,* Fall 1987 (pgs. 96–103).

Another group of known sonar transducers may be classified as flextensional. In flextensional transducers, the electroactive driver is separate from, but rigidly mechanically connected to, the acoustic radiating member.

Regardless of the transducer configuration, imposition of flexing forces and resulting bending stresses on electroactive driver elements limits the instantaneous peak power and average power, of acoustic energy that can be generated by the transducer. Care must be taken not to exceed bending stresses, especially when applied in tension to the driver, which may damage and/or cause catastrophic failure of the driver. A typical acoustic driver may be made up of a plurality of segments of electroactive material, and the loss or failure of even one segment due to mechanical failure may cause severe loss of power handling capability of the entire transducer.

It would be desirable to provide a transducer wherein the driver is not subjected to flexing forces or bending stresses while still able to generate acoustic energy of relatively high power at relatively low frequency. As used herein, low frequency means less than about 1000 Hz, although the present invention is not limited to operation at such frequencies. It would also be desirable to have the acoustic radiating means include a flat member for ease of manufacture and assembly/disassembly of the transducer.

Accordingly, it is an object of the present invention to provide a transducer having electroactive, or other, driver means for generating acoustic energy, wherein the electroactive, or other, driver means are not either part of, or rigidly connected to, acoustic radiating means of the transducer, so that flexing forces and/or bending stresses to which the electroactive driver means may be subjected are substantially reduced and/or eliminated.

Another object of the present invention is to provide a transducer having acoustic radiating means including a flat member for generating acoustic energy, wherein the transducer and components thereof can be readily assembled/disassembled, repaired and/or replaced, especially as applied to components of the entire electroactive driver means, without need for special or sophisticated tooling or alignment procedures.

SUMMARY OF THE INVENTION

In accordance with the present invention, in an acoustic transducer having driver means for urging acoustic energy from the transducer, support apparatus for reducing predetermined stress on the driver means comprises driver mounting means and purchase means for connecting to the driver means and for pivotally connecting to the driver mounting means such that pivoting of the purchase means with respect to the driver mounting means reduces the predetermined stress.

The driver mounting means may include a member, such as a screw, having a portion with a first contour and the purchase means may include recess means with a second contour complementary to the first contour for receiving the portion of the member. The first contour may be spherical, oval, elliptical, conical and the like. The driver mounting means may also include a screw having a head at one end and the other end for pivotally connecting to the driver mounting means.

The purchase means may include a recess having a first contour and the driver mounting means may include engaging block means having a recess with a second contour, the second contour being registrable with the first contour, screw means for urging the engaging block toward the purchase means, and separation means, such as a ball bearing, partially disposed in both recesses for maintaining separation between the engaging block and the purchase means while permitting pivoting of the purchase means with respect to the driver mounting means. The first and second contour may each be conical and the separation means may include a spheroid or a sphere.

In another aspect of the present invention, a transducer assembly comprises acoustic radiating means for generating energy in a transmitting medium and driver means for urging the radiating means to generate the acoustic energy, wherein the driver means are pivotally coupled to the acoustic radiating means for relieving predetermined stress on the driver means while urging the radiating means to generate the acoustic energy.

The driver means may include an electroactive material such as, for example, piezoelectric ceramic, electrostrictive ceramic, magnetostrictive nickel, rare earth magnetic materials and combinations thereof. The acoustic radiating means may include a flat member such as a bar, a plate or a disk, or an I-shaped member with the driver means pivotally coupled to a leg of the I-shaped member, or a pair of spaced apart disks with the driver means pivotally coupled to each disk.

First and second driver means may be respectively disposed on each side of a major plane of a disk and pivotally coupled thereto for urging the disk to flex in a direction transverse the major plane of the disk for generating the acoustic energy. When such a pair of driver means is used, one of the pair will typically be activated out of phase, such as opposite to, or 180° out of phase with, the other one of the pair.

The driver means may include an elongated member wherein the elongated member is disposed so that its longitudinal axis is substantially parallel to the major plane through the disk.

In yet another aspect of the present invention, a transducer assembly for generating acoustic energy in a medium comprises first and second spaced apart acoustic radiating means, a member having a first and second side with a first and second portion of the member respectively rigidly connected to the radiating means, and a plurality of driver means disposed on each side of the member with the driver means pivotally connected to the first and second radiating means. The first and second driver means cooperate to urge movement of the first and second radiating means when the first and second driver means are subjected to an electroactive means for causing a physical change in the first and second driver means. The movement of the radiating means is for generating the energy while predetermined stress on the driver means is relieved when the driver means pivot with respect to the radiating means.

The driver means may include an electroactive material such as piezoelectric ceramic, electrostrictive ceramic, magnetostrictive nickel, rare earth magnetic materials and combinations thereof. Further the driver means may be respectively circumferentially spaced apart, with the member including a hollow cylinder that is disposed between the respective plurality of driver means Adjustable driver mounting means may be used to connect the driver means to the radiating means for supporting forces in a first predetermined direction while permitting pivoting of the driver means with respect to the radiating means in a second predetermined direction for relieving predetermined stress on the driver means.

The features of the invention believed to be novel are set forth with particularity in the appended claims. The invention itself, however, both as to organization and method of operation, together with further objects and advantages thereof, may best be understood by reference to the detailed description taken in connection with the accompanying drawing.

BRIEF DESCRIPTION OF THE DRAWING

FIG. 3C is a graphical representation of a typical response of the transducer assembly of FIG. 1 to driving frequencies.

DETAILED DESCRIPTION

Figure 1:
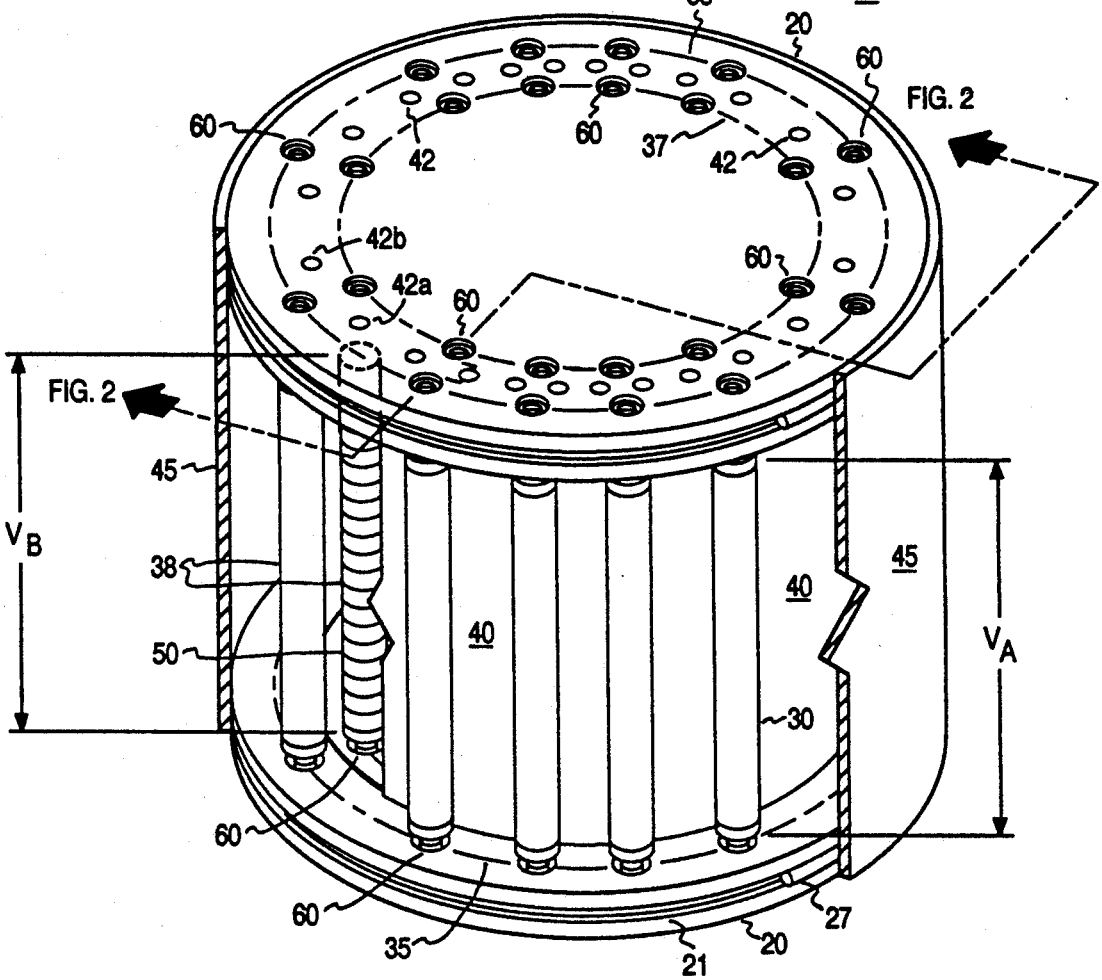
FIG. 1 is a perspective view of a transducer assembly, with a cover and component partially cut away for ease of viewing, in accordance with the present invention.

Referring to FIG. 1, a perspective view of a transducer assembly, with a cover and components partially cut away for ease of viewing, in accordance with the present invention, is shown. Transducer assembly 10 includes acoustic radiating means 20, such as a pair of spaced apart flat plates or disks, a first plurality of outwardly disposed elongated generally evenly circumferentially spaced apart driver means 30 extending between and pivotally connected at the ends thereof to respective disks 20 via driver mounting means 60 that are disposed generally evenly spaced apart and along the circumference of respectively registered circles 33 and 35 for engaging a corresponding end of driver means 30, and support means 40, such as a hollow cylindrical nodal ring, spaced from, and disposed interior to, driver means 30 and connected to disks 20 at respective ends of support means 40.

As used herein the term disk generally refers to a solid cylindrical member, or to a hollow one with a cap or cover at each end, having a thickness that is substantially less than its diameter. A major plane of a disk is a plane which is substantially parallel to an end or a flat surface of the disk.

Disk 20 may include a non-electroactive material, such as a metal or composite. The material selected for disk 20 must be able to sustain flexure and bending stresses during operation without permanently deforming. That is, disk 20 should exhibit sufficient elasticity to return to its original shape when all flexing and external forces are removed therefrom. Metals such as steel, aluminum, titanium, brass and composites such as carbon-carbon and fiber reinforced materials may be used, as they are readily available, relatively inexpensive, and able to be machined and shaped using conventional methods. The material selected for disks 20 should also be compatible with the environment, especially the transmitting medium, with which it may be operated. In addition, or alternatively, disks 20 may be covered by a material, such as polyurethane or rubber, that is impervious to the transmitting medium, for physically, but not acoustically, isolating disk 20 from the transmitting medium.

Of course, if desired, only one flexible disk 20 may be used, with the other disk 20 of transducer 10 being replaced by a rigid member or by a substantially immovable object, such as a hull of a ship. However, a transducer analogous to that of FIG. 1 which uses only a single disk 20, will not generally be able to generate a waveform having as much energy as one of the same size using two disks 20 would be able.

In the embodiment of the present invention illustrated in FIG. 1, disks 20 generate acoustic energy in a transmitting medium, such as water, when the transmitting medium is moved by movement of disk 20. One of the benefits of the present invention is that the material for the acoustic radiating means does not need to include a generally more fragile and brittle material, such as a piezoelectric ceramic, that has been employed as a constituent of a radiating element of prior transducers.

Transducer assembly 10 also includes a second plurality of elongated spaced apart driver means 50, a corresponding one of the second plurality of driver means 50 disposed radially inwardly and spaced from each of driver means 30. Driver means 30 and corresponding driver means 50 disposed along the same radial ray and on the same side of the center of disk 20 form an operational driver pair 38. Driver means 50 may be the same as driver means 30. Driver means 50 extend between and are pivotally connected at respective ends thereof to respective disks 20 via driver mounting means 60 that are disposed generally evenly spaced apart and along the circumference of respectively registered circles 37 and 39 for engaging a corresponding end of driver means 50.

Nodal ring 40 abuts a disk 20 at respective ends of ring 40 and is rigidly secured to disks 20 by a plurality of circumferentially spaced apart joining means 42, such as a bolt or machine screw that is received in a threaded hole disposed in the end of nodal ring 40, representative ones of which are identified. Typically, a pair of joining means 42, such as indicated at **42*a* and 42*b* are circumferentially spaced apart to straddle the radial line between driver mounting means 60 of an operational drive pair 38 of driver means 30 and 50 for ensuring that nodal ring 40 is rigidly connected to disk 20 during operation. Additional joining means 42 may be disposed as desired for securing nodal ring 40 to disk 20. Nodal ring 40 is preferably centrally disposed between driver means 30 and driver means 50** for ensuring that each half of an energy waveform to be generated will be equal.

A cover 45 may be circumferentially disposed radially outboard driver means 30 and around the periphery of disks 20 to form a drum-like structure. Disks 20 are preferrably substantially parallel to each other and registered so that in combination with cover 45 they form a right cylinder. Cover 45 may be further disposed to sealingly engage disk 20, such as in combination with an O-ring 27 fitted in a groove 21 that is disposed in the edge of disk 20, for preventing transmitting medium from entering the interior of transducer assembly 10 during operation. It is noted that the central portion of transducer assembly 10 is substantially hollow, which space may be beneficially used to accommodate electronics and other elements.

Figure 2:
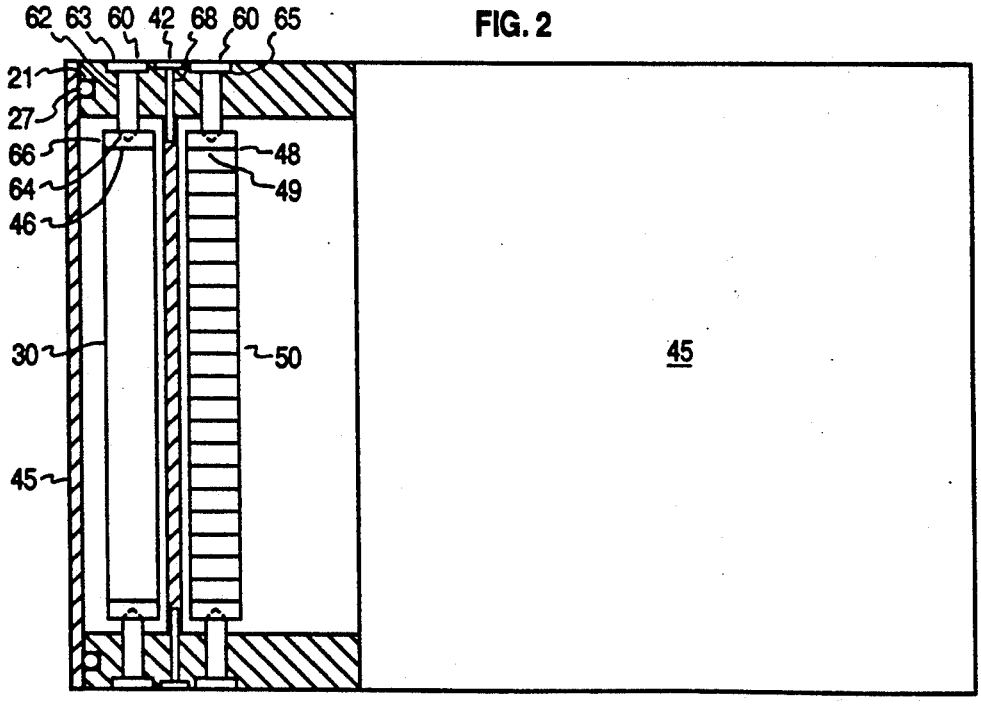
FIG. 2 is a view looking in the direction of the arrows of line of FIG. 1 that are labelled FIG. 2.

Referring to FIG. 2, a view looking in the direction of the arrows of FIG. 1 that are labelled FIG. 2, but not necessarily to scale, is shown. Driver mounting means 60 include a bolt or screw 62 having an end 64 terminating in a conical profile and an opposite head end 63, which may be slotted, or include a hexagonal recess for receiving an Allen wrench, for applying torque to screw 62, and purchase means 66, such as a block, having a conical recess 68 complementary to that of end 64 of screw 62 for receiving end 64 of screw 62. Purchase means 66 may be fixedly or removably connected to each end of driver means 30 and 50.

However, adjustable driver mounting means 60 for exerting the desired compressive force on driver means 30 and 50 along the longitudinal axis thereof may be required at only one end of driver means 30 and 50. In such case, a pin or stud that is operationally fixedly connected to disk 20 at one end of the pin or stud, and having the other end being terminated analogously as end 64 of screw 62 can be terminated, may be used. Corresponding block 66 includes a recess 68 having a contour complementary to that of the other end of the pin or stud for receiving same.

A typical measurement of about 60° between diametrically opposed meridians for end 64 and recess 68 may be used when both are desired to be conical. Alternatively, end 64 may terminate in a ball or hemisphere, or oval, or elliptial contour with recess 68 being contoured complementary thereto. Lubrication may be provided between end 64 and recess 68 for reducing friction therebetween during operation at which time end 64 of screw 62 may pivot in recess 68 for relieving stress in driver means 30 and 50. Cooperation and pivoting between end 64 of screw 62 and recess 68 of block 66 relieves predetermined stresses, such as those which may result from forces applied laterally and/or obliquely to the longitudinal axis of driver 30 and 50, which may otherwise be exerted on driver 30 and 50, while permitting desired compressional forces to be applied along and/or parallel to the longitudinal axis of driver 30 and 50.

Disk 20 includes a hole 61 having threads that are complementary to those of screw 62. Alternatively, an internally threaded sleeve or bushing, or a coiled spring whose interior passageway mates with the thread size and pitch of screw 62, may be disposed in hole 61 if the material of disk 20 does not readily accept internal threads or the operational stresses to be applied thereto by driver mounting means 60. Hole 61 may include a counter sink or counter bore 65 at its leading edge for receiving head 63 of screw 61 so that head 63 is flush with or recessed with respect to the upper surface of disk 20.

Driver means 30 and 50 may be the same, or a different configuration may be selected for each, if desired. Driver means 30 and 50 include an electroactive material 32, such as piezoelectric ceramic, electrostrictive ceramic, magnetostrictive nickel, rare earth magnetic materials, combinations thereof, and the like. An electroactive material as the term is used herein means a material which reacts by a change in physical dimensions when exposed to one or more of an activating phenomenon for influencing the material, such as a voltage differential applied across the material, a current flow through the material, or an interception by the material of magnetic flux of a magnetic field.

By way of example, shown in FIG. 1, are voltage $V_A$, which is applied to driver means 30, and voltage $V_B$, which is applied to driver means 50, wherein driver means 30 and 50 are selected to be electrically activated. Generally, all driver means 30 will be connected, such as electrically or magnetically, to be actuated in parallel with each other and all driver means 50 will likewise be connected to be actuated in parallel with each other so that application of voltage $V_A$ will cause driver means 30 to all move in the same direction, or to perform the same function, such as physically expand or contract, at the same time, while application of voltage $V_B$ will cause driver means 50 to all move in the same direction, or to perform the same function, such as physically expand or contract, at the same time. Thus, by controlling the phase between voltage $V_A$ and $V_B$, the phase of the motion between driver means 30 and 50 may be likewise controlled.

Two mechanical configurations for electroactive material 32 are illustrated. For driver 30, material 32 is shown as a single elongated cylinder and for driver 50, which is a presently preferred configuration, material 32 makes up a plurality of individual segments wherein the segments are stacked for forming the desired cylinder and for each driver 50 are connected to operate in parallel in response to the activating phenomenon. These configurations for material 32, or other configurations therefor such as an elongated bar or rod, may be used as desired, and the present invention is not limited by the type or configuration of driver means 30 and 50 employed. Further, inasmuch as driver means 30 and 50 are not subjected to flexing forces and bending stresses, as hereinafter explained, the choice of a desired configuration thereof may be more varied than for prior transducers wherein the driver was subjected to flexing forces and bending stresses.

The end of nodal ring 40 which abuts disk 20 may be tapered or relieved from the outside and/or inside of nodal ring 40 as shown by references 46 and 49, respectively, in order to provide a minimum bearing surface 48 at the ends of nodal ring 40 for abutting disk 20, which bearing surface 48 will function as a localized fulcrum for disk 20 during operation.

Figure 3A:
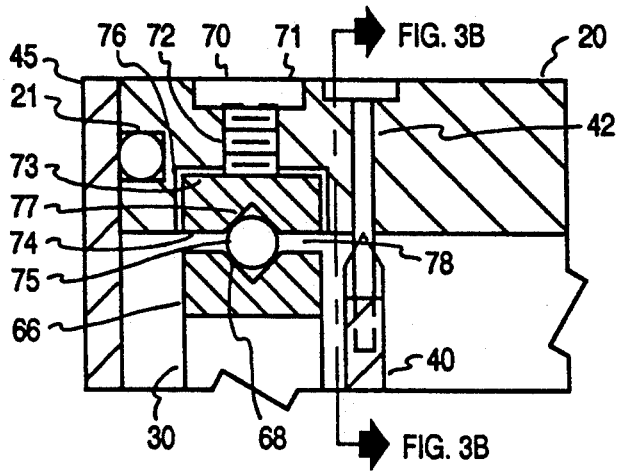
FIG. 3A is a plan elevational view of another embodiment of driver mounting means in accordance with the present invention.

Referring to FIG. 3A, another embodiment of driver mounting means, not necessarily to scale, is shown. Driver mounting means 70 includes a screw, or bolt, 72 having a head 71 at one end and terminating in a flat surface at the other end 73. Alternatively, end 73 may terminate in other shapes, such as spherical, conical, or oval as long as such termination permits screw 72 to exert, maintain and sustain operational force on an engaging block 74. Engaging block 74 is disposed in a complementary recess 76 in the underside of disk 20. Engaging block 74 includes a conical recess 77 that is operationally registered with recess 68 of purchase means 66 for retaining separation means 75, such as a spheroid or a ball bearing, therebetween, wherein spheroid as used herein means a figure like a sphere, but which is not spherical, such as an ellipsoid of revolution. Engaging block 74 may be a rectangular solid or cube that includes a face large enough for providing a bearing surface for end 73 of screw 72 and an opposing face large enough to receive recess 77. Recesses 68 and 77, and ball bearing 75 are appropriately sized to maintain a space, or separation, 78 between engaging block 74 and purchase means 66 when ball 75 contacts the sides of recess 68 and 77 so that engaging block 74 and purchase means 66 do not contact each other during operation. Besides maintaining such separation, ball bearing 75 also allows pivoting of purchase means 66 and corresponding driver means 30 with respect to driver mounting means 70 about ball bearing 75.

Figure 3B:
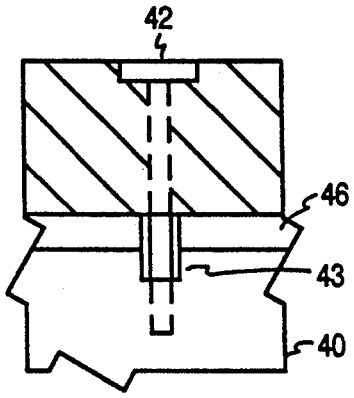
FIG. 3B is a view looking in the direction of the arrows of the line of FIG. 3A that is labelled FIG. 3B.

Referring to FIG. 3B, a view looking in the direction of the arrows of the line of FIG. 3 labelled FIG. 3B, is shown. Nodal ring 40 may include a relief, recess or notch 43 in the end thereof that is disposed transverse the sides of ring 40 for receiving joining means 42. Recess 43 facilitates tapping threads into the end of ring 40 inasmuch as the interior and exterior surfaces of ring 40 include taper 46 and 48 (FIG. 2) at the ends thereof.

Figure 4:
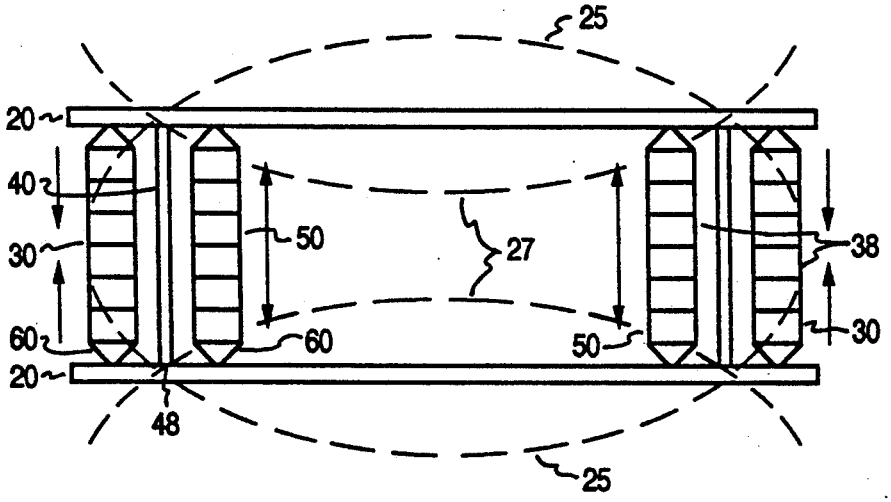
FIG. 4 is a schematic diagram that is useful for illustrating the operation of the transducer assembly of FIG. 1 in accordance with the present invention.

Referring to FIG. 4, a schematic diagram that is useful for illustrating the operation of the transducer assembly 10 of FIG. 1 in accordance with the present invention is shown.

A respective one of driver means 30 and 50 are disposed to operate as an opposing operational pair 38. When driver means 30 are polarized, activated or influenced in a first predetermined direction, they expand or elongate, and when they are polarized, actuated or influenced in a second predetermined direction, they contract or shrink, the second direction being opposite the first direction. The first and second direction may be in response to voltage, current flow, magnetic field flux or other activating or influencing phenomena that will cause the desired physical change in driver means 30. Driver means 50 may be similarly influenced or activated.

Typically all driver means 30 are interconnected to be activated in parallel so that they all physically change in the same direction at the same time, and all driver means 50 are likewise connected to be activated in parallel so that they also all physically change in the same direction at the same time, but in a direction opposite to, or 180° out of phase with, that of driver means 30. Thus, when driver means 30 expand, driver means 50 contract and vice versa. Other interconnection and phasing among each of driver means 30 and 50, respectively, and between driver means 30 and 50 may be used as desired for producing a desired energy wave.

Operational opposing out of phase expansion and contraction of drivers 30 and 50 of driver pair 38 will cause a localized bending or flexing of disk 20 in the region of corresponding driver mounting means 60, which ultimately will result in a reciprocating or oscillatory bending of disk 20 as indicated by dashed lines 25 and 27, but not necessarily to scale. The ends 48 of nodal ring 40 serve as a fulcrum for such movement of disk 20 in the vicinity of driver mounting means 60. It is noted that outward and inward movement to positions 25 and 27, respectively, are in phase for both disks 20 of transducer 10. Of course, other phasing schemes for drivers 30 and 50 may be used for obtaining different shaped generated waves if desired.

Bending or flexing of disk 20 will cause disk 20 to rock at nodal ring 40 and to pivot at driver mounting means 60, which pivoting relieves lateral and oblique forces that would tend to cause bending or flexing of driver means 30 and 50. However, driver mounting means 60 are able to withstand and support compressional forces that are exerted by disk 20 in a direction parallel to the longitudinal axis of driver means 30 and 50.

As driver means 30 and 50 alternately expand and contract under the influence of the activating phenomenon, typically in a periodic fashion, such as sinusoidal, for generating a wave of energy having the desired parameters, disks 20 are urged to move between their quiescent state and extended state as indicated by broken lines 25 and 27. Movement between the quiescent and extended state of each of disks 20 is in phase which causes the surrounding transmitting medium to be directed away from each of disks 20 at the same time, and with approximately the same force. Such movement of disks 20 creates energy waves in the transmission medium having a pattern or periodicity that corresponds to, or is responsive to, the motion of disks 20.

It is well known that when the size of an energy or wave generator, such as transducer assembly 10, is substantially less than the wavelength of the energy waves that are generated in the transmission medium, then the wave generator may be regarded as having a negligible effect on the direction of propagation and distortion of the generated wave. Thus, transducer assembly 10 may be used to produce a low frequency energy wave in a transmission medium, such as water, that is substantially uniform and omni-directional and/or directional, at least once the wave is beyond the near field effects of transducer 10, such as may be readily determined as known in the art.

Figure 6:
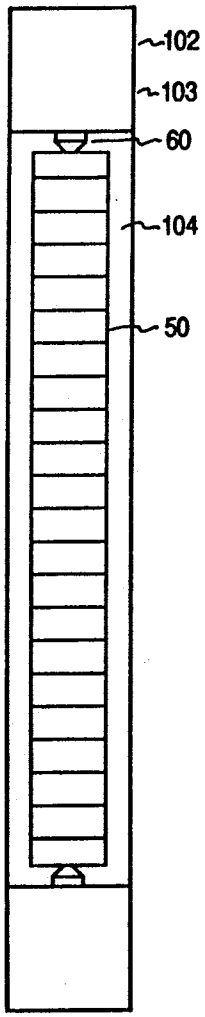
FIG. 6 is a view looking in the direction of the arrow of FIG. 5 that is labelled FIG. 6.
Figure 5:
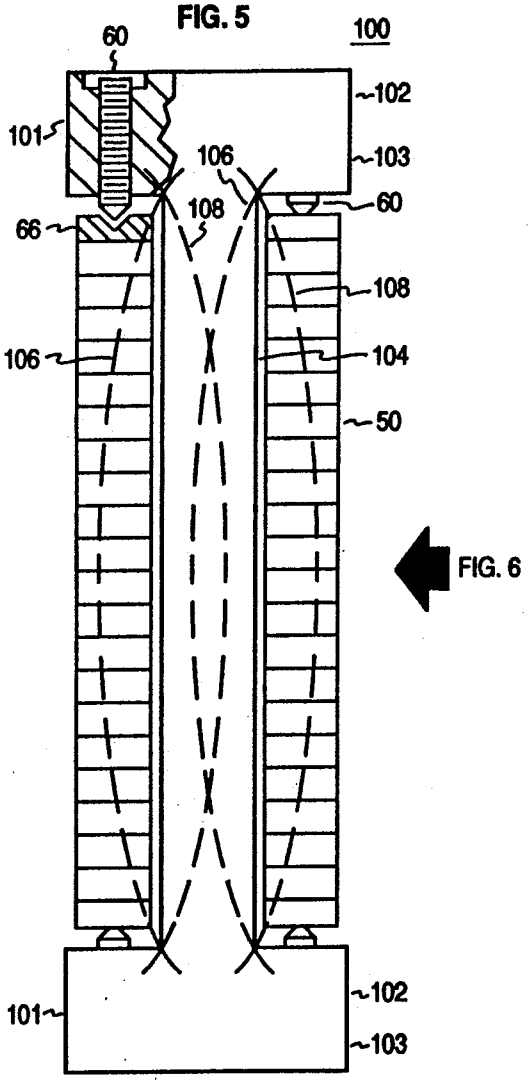
FIG. 5 is a plan elevational view of another embodiment of a single transducer in accordance with the present invention.

Referring to FIGS. 5 and 6, another embodiment of a single transducer in accordance with the present invention is shown. Transducer assembly 100 includes a central rib 104 which extends between, and is connected at each end to, a transverse member 102 to form an I-or H-shaped device. Corresponding legs 101 and 103 of transverse member 102 include driver means 50 extending therebetween and connected to corresponding leg 101 and 103 of member 102 by driver mounting means 60 that are disposed in leg 101 and 103 and although shown spaced from purchase means 66, will operationally engage purchase means 66. One or both of driver means 50 may be of the configuration shown for driver means 30 of FIG. 1, or of any other desired configuration compatible with transducer 100.

Driver means 50 form an opposing operational pair which are connected to be activated out of phase, or opposite to each other, with respect to changes in physical characteristics of driver means 50. For example, when left side driver means 50 of FIG. 5 is expanding, right side driver means 50 will contract, and vice versa. Mounting means 60 permits pivoting of driver means 50 to reduce or eliminate lateral and oblique forces on driver means 50 while supporting longitudinal forces as explained above.

During operation, transducer assembly 100 is immersed in a transmitting medium. One of driver means 50, say the left one of FIG. 5, will be directed to expand while the other driver means 50, say the right one of FIG. 5, will be urged to contract by activating phenomenon commands so that rib 104 will be deflected to assume a contour indicated by broken lines 106, but not necessarily to scale. When the activating phenomenon commands are reversed so that right driver means 50 expands and left driver means 50 contracts, rib 104 will be deflected to assume a contour indicated by broken lines 108, but not necessarily to scale. Alternate activation and reversal of appropriate driver means 530 will cause rib 104 to oscillate, or alternately translate, between position 106 and 108, thereby causing corresponding energy waves to be generated in the transmitting medium that is disposed adjacent rib 104 by lateral driving surfaces 107 and 109 of rib 104.

Figure 7:
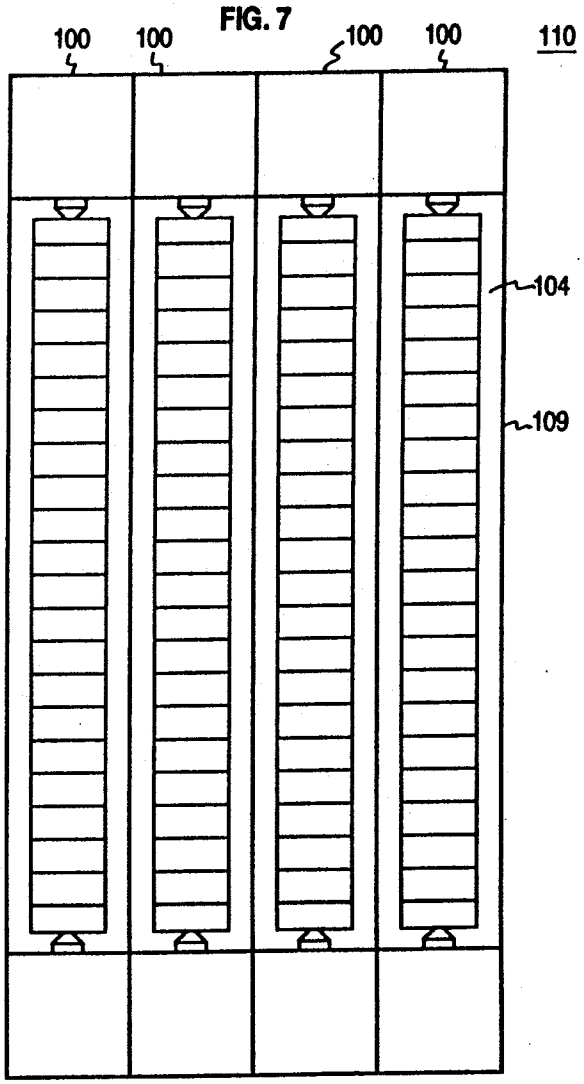
FIG. 7 is a plan elevational view of a plurality of transducers of FIG. 5 arranged to form a transducer assembly in accordance with the present invention.

Referring to FIG. 7, a plan elevational view of a plurality of transducer assemblies of FIG. 5 that are arranged to form another transducer assembly in accordance with the present invention is shown.

Transducer assembly 110 comprises a plurality transducer assemblies 100, which are arranged in abutting side-by-side relationship and which may be secured or retained by a bonding agent such as epoxy or bolting through the sides of the assembly, such that ribs 104 form a wall 109 dividing one set of driver means 50 from the other set of driver means 50. Driver means 50 that are disposed on one side of ribs 104 are connected to be activated in parallel so that they all physically change in the same direction at the same time, while driver means 50 that are disposed on the other side of ribs 104 are likewise connected to be activated in parallel so that they also all physically change in the same direction at the same time, but in a direction opposite to, or 180° out of phase with, those of driver means 50 that are disposed on the one side of ribs 104. Transducer assembly 110 may be used, for example, when it is desired to move more of the transmitting medium that is disposed adjacent the assembly and thereby increase the energy or power of the generated wave over that possible by using a single transducer assembly 100.

Once again, depending on the size of transducer assembly 100 and of transducer assembly 110 with respect to the wavelength of the energy wave respectively generated by each in the transmitting medium, they may both be used for generating substantially uniform omni-directional and/or directional energy waves outside the near-field zone.

For both transducer assemblies 100 and 110, driver means 50 and/or the entire assembly 100 and 110 may be packaged so as to be physically but not acoustically isolated and/or insulated from the environment and operating medium as is known in the art.

Figure 8:
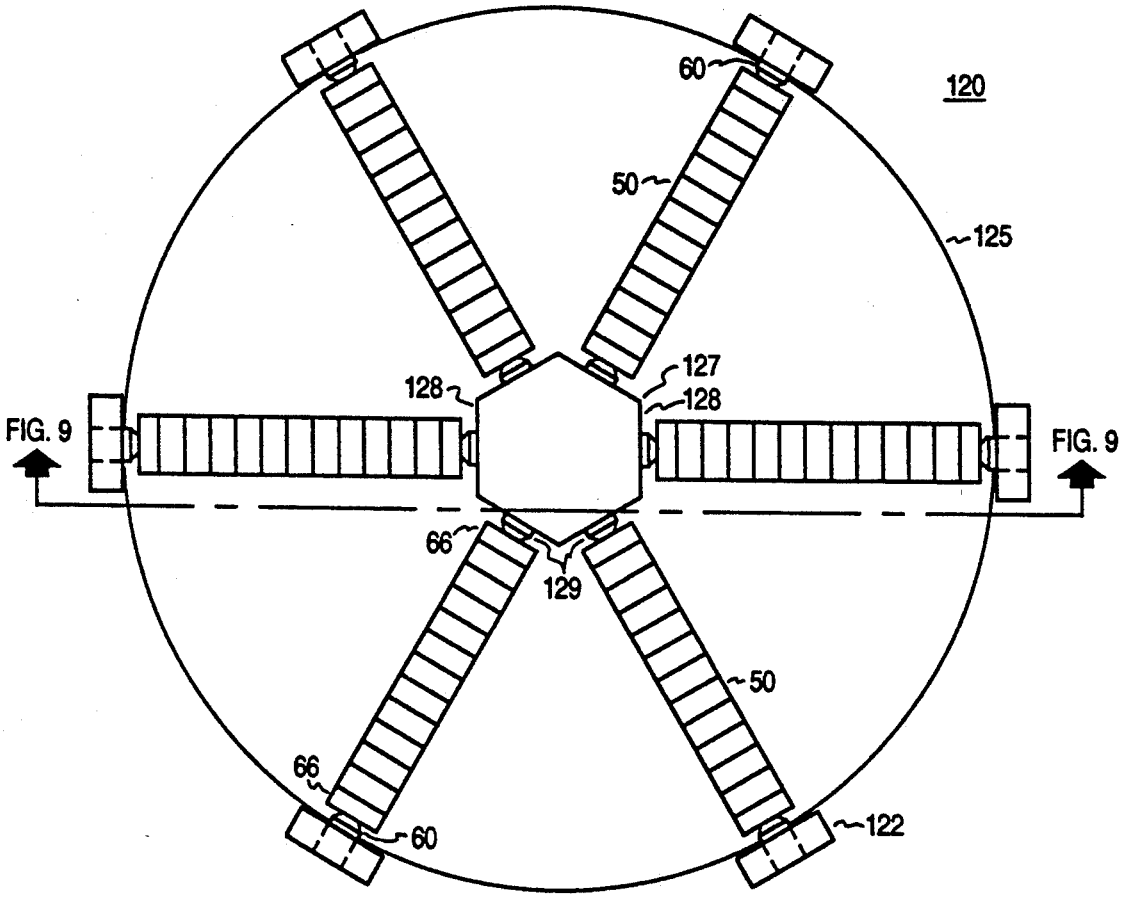
FIG. 8 is a plan elevational view of still another embodiment of a transducer assembly in accordance with the present invention.
Figure 9:
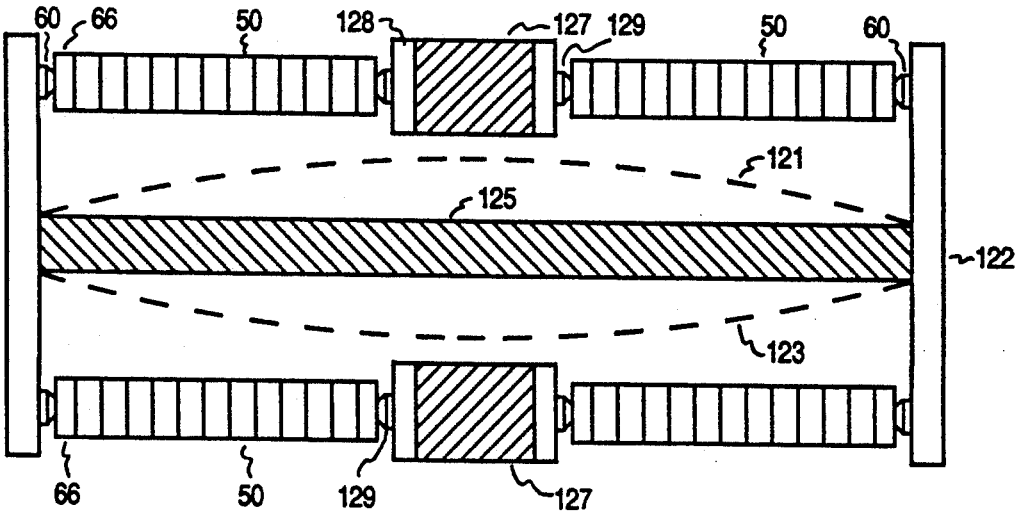
FIG. 9 is a view looking in the direction of the arrows of the line of FIG. 8 that is labelled FIG. 9.

Referring to FIGS. 8 and 9, still another embodiment of a transducer assembly in accordance with the present invention is shown.

Transducer assembly 120 comprises a disk 125, which may be the same as disk 20 (FIG. 1), having a plurality of support means 122, such as a bar or strap, fixedly connected to the outer periphery of disk 125 and disposed transverse the upper and lower surfaces of disk 125. The material of disk 125 and support means 122 may be as described above with respect to disk 20. The material of support means 122 may be the same as or different from the material of disk 125.

Support means 122 may be integral disk 120 or fixedly connected thereto such as by welding, brazing, soldering, bonding or other methods known for connecting similar or dissimilar materials. When support means 122 are not integral disk 122, they may be of the same or dissimilar material providing that support means 122 are able to withstand without deforming the operational forces to be applied thereto, and further provided that the connection between disk 125 and support means 122 is able to withstand such forces without breaking or deforming. Each of support means 122 includes driver mounting means 60 disposed therethrough, representative ones of which are schematically represented by a pair of broken lines.

Each of the plurality of support means 122 is shown circumferentially spaced apart from adjacent support means 122 and is disposed at the periphery of disk 125 to extend away from the upper and lower surface of disk 125. When support means 122 include a strap, the strap 122 may be generally centrally connected to the periphery of disk 125 transverse the longitudinal direction of the strap 122 as shown in FIG. 9.

Centrally disposed and spaced away from the upper and lower surface of disk 125 is a pair of blocks 127 having a plurality of lateral surfaces 128, wherein the number of surfaces 128 of each block 127 corresponds to the number of driver means 50 desired to be coupled to disk 125, on each side of major plane through disk 125.

As used herein, terms of direction such as upper, lower, left, right, etc. are for convenience of description and illustration only, and are not to be construed as limiting the operation of transducer assemblies in accordance with the present invention, which are intended to be operable in any spatial orientation.

Extending from each lateral surface 128 of block 127, is a pin or stud 129 having a conical or other shape contoured end remote from lateral surface 128 for engaging purchase means 66 (FIG. 2) that is disposed at an end of driver means 50 as explained above. Purchase means 66 that is disposed at the other end of driver means 50 engages mounting means 60. Stud 129 and corresponding mounting means 60 are disposed so that driver means 30 is substantially parallel to the upper or lower surface of disk 125 during the quiescent stage of operation. Stud 129 may not be necessary and driver means 50 may be directly connected to block 127 if pivoting of driver means 50 at mounting means 60 is adequate to relieve undesired stresses.

As shown in FIG. 8, lateral surfaces 128 of block 127 form a regular hexagon in plan view so that each of driver means 50 radially extends from block 127. One of a pair of driver means 30 extend from either side of block 127, along the same diameter, as in opposite radial directions, from block 127. Block 127 may be considered to be a floating hub that is supported away from disk 125 by driver mean 50.

It is not necessary that each of driver means 50 have a corresponding mating driver means 50 lying along the same diameter through block 127. In fact, if desired, other configurations for lateral surfaces 128 of block 127, such as one which forms an odd-sided polygon, like a triangle or pentagon in plan view, may be used with mounting means 60, stud 129, if desired and driver means 50 arranged accordingly.

Regardless of the configuration selected for block 127 and driver means 50 or one side of disk 125, the other side of disk 125 will generally have the same configuration for block 127 and driver means 50. The configuration of block 127 and driver means 50 on each side of disk 125 will be registered with respect to each other so that corresponding driver pairs including an upper and lower driver 50 are formed. It is noted that the longitudinal axis of driver means 50 is substantially parallel to the upper or lower surface of disk 125, or to a major plane through disk 125.

On each side of disk 125 driver means 50 are respectively interconnected in parallel, so that at the same time all upper drivers 50 of FIG. 9 may be directed to expand while all the lower ones may be directed to contract and vice versa causing flexture of disk 125. The maximum outward extent of movement from the quiescent position for the upper and lower surfaces of disk 125 due to flexure of disk 125 that is induced by driver means 50 is indicated by dashed lines 121 and 123, respectively, but not necessarily to scale. Block 127 and driver means 50 must be spaced from the corresponding upper and lower surface of disk 125 so that disk 125 does not contact driver means 50 and block 127 during operation.

Figure 10:
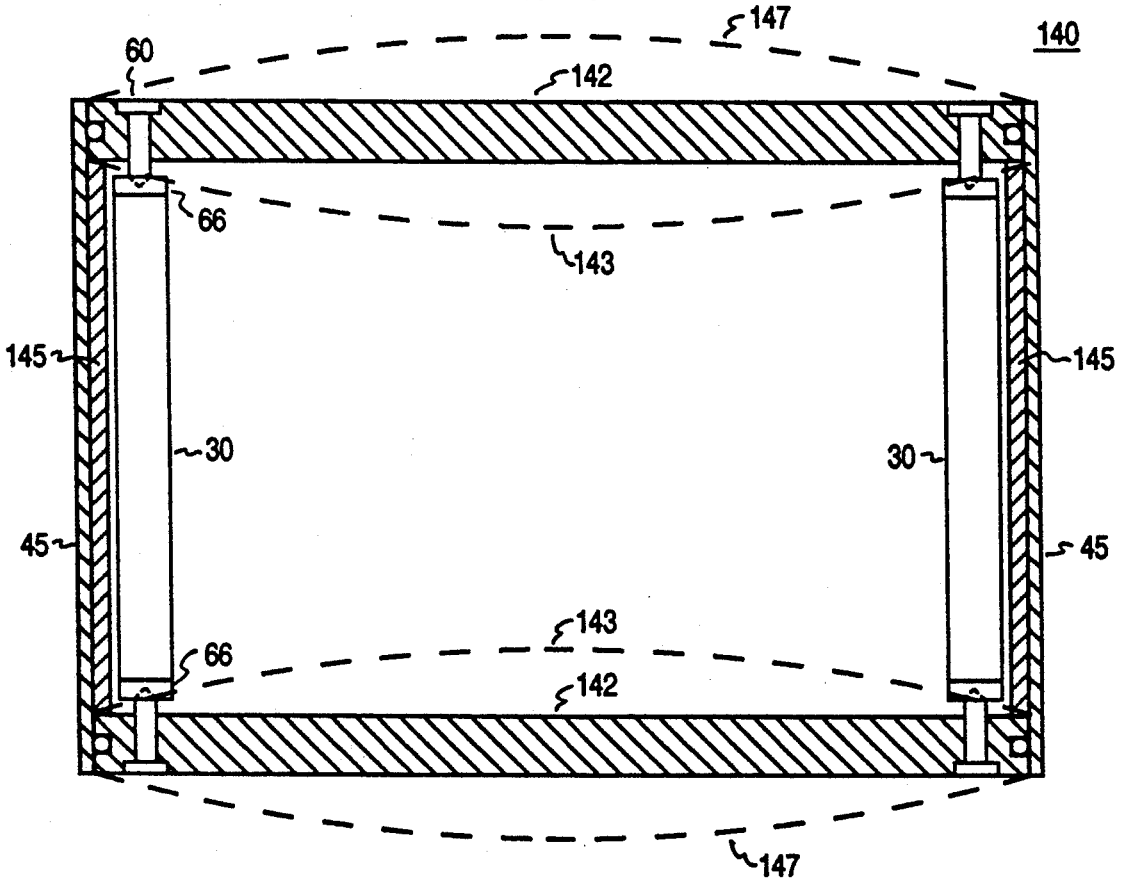
FIG. 10 is a plan elevational view of another embodiment of a transducer assembly in accordance with the present invention.

Referring to FIG. 10, a plan elevational view of another embodiment of a transducer assembly in accordance with the present invention is shown.

Transducer assembly 140 includes a pair of parallel spaced apart flat disks or plates 142 having a circumferential nodal ring 145 connected to a flat surface of each of disks 142 at the outer periphery of disk 142. Inwardly spaced from nodal ring 145 and mutually circumferentially spaced apart from each other is a plurality of driver means 30 that extend between the same surfaces of disk 142 as does nodal ring 145. Each end of driver means 30 may include purchase means 66 for engaging driver support means 60 that are disposed in plate 142. Transducer 140 as shown is thus somewhat similar to transducer 10 of FIG. 1, but lacking at least driver means 50 for forming coordinating driver pairs 38 with nodal ring 40 centrally disposed therebetween. Nodal ring 140 may be secured to each of plates 142 by joining means 42 as illustrated and described in conjunction with FIG. 1. Of course the configuration of driver means 50 as shown in FIG. 2, may be used in place of that shown for driver means 30. The ends of nodal ring 145 may be relieved or tapered as were those shown for nodal ring 40 (FIG. 2). A cover 45 may circumferentially surround and sealing by engaging the edges of disks 14 for preventing transmitting medium from entering the interior of transducer assembly 140.

Driver means 30 of transducer 140 are all connected in parallel so that they all physically expand and contract in phase with each other. Broken lines 143 and 147 represent motion of disks 142 inwardly and upwardly, respectively, but not necessarily to scale, with respect to the center of transducer 140 in response to urging by longitudinal contraction and expansion, respectively, of driver means 30.

The material and sizing of nodal ring 142, as well as that of nodal ring 40 (FIG. 1), should be selected to be rigid overall or to permit slight lateral flexing without translation, i.e., stretching or elongation, under tension so that plates 142 will not undesirably move apart from each other. Any such undesirable motion of plates 142 will impart unwanted frequencies and/or distortion into the wave generated by transducer 140.

For most applications, an even number of driver means 30, and corresponding number of driver devices 50 for transducer 10, being equally circumferentially spaced from each other are desired for transducer 10 and 140. An even circumferential spacing of drivers 30 and 50 will establish a substantially symmetrical drive with oscillations of corresponding disks 20 and 142 in response to actions of driver means 30 and/or 50 expected to be primarily in a fundamental mode without overtones. Of course, drivers 30 and 50 may be unevenly spaced to produce an asymmetrical energy pattern with overtone modes if desired.

Figure 11A:
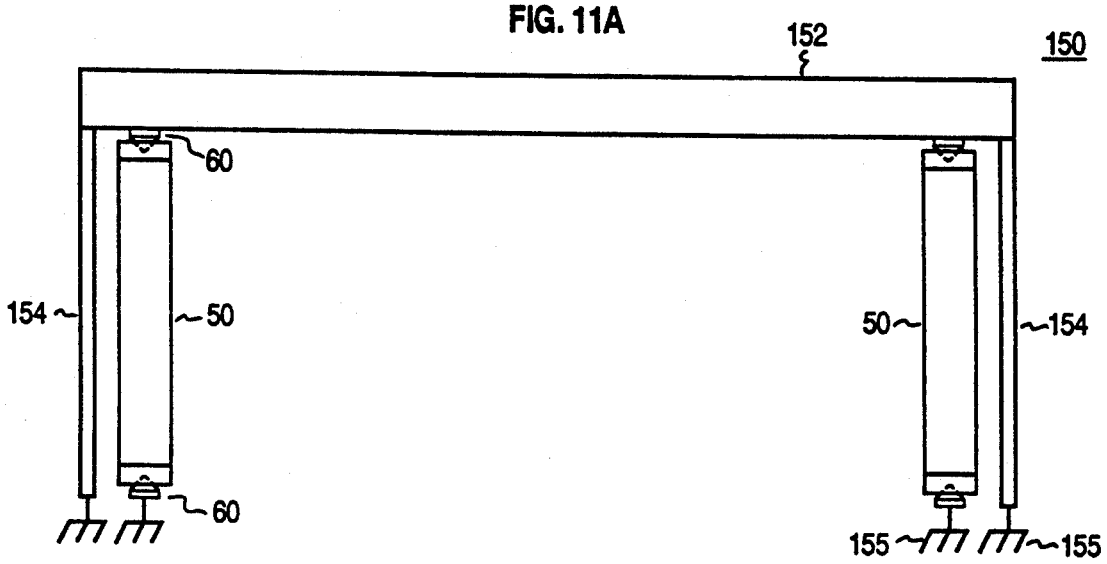
FIG. 11 is a plan elevational view of still another embodiment of a transducer assembly in accordance with the present invention.
FIG. 11B is a top view of the transducer assembly of FIG. 11A.
Figure 11B:
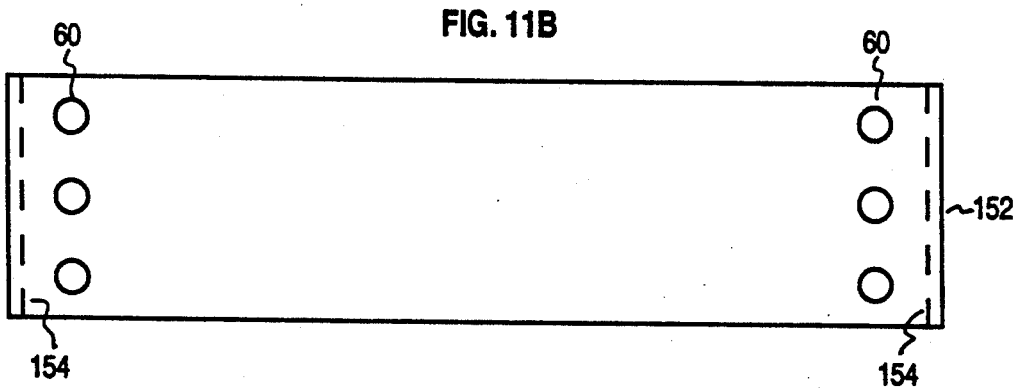

Referring to FIGS. 11A and 11B, views of a transducer assembly in accordance with the present invention are shown.

Transducer assembly 150 includes acoustic radiating means 152, such as a bar fixedly operationally connected to opposing ends of bar 152, and a plurality of driver means 50 respectively inwardly disposed from support member 154 and pivotally coupled to bar 152 by corresponding drive support means 60. The other end of support member 154 and driver means 50 may be connected and pivotally connected, respectively, to another bar 152 or to a relatively immovable object with respect to operational bar 152, such as a hull of a ship, as represented schematically by reference numeral 155, so as to prevent support member 154 from translating longitudinally under tension during operation. The sides of transducer assembly 150 may be sealed so that during operation, transmitting medium does not enter the interior of the bar-like structure so formed.

In all embodiments of the present invention, the apparatus may be readily assembled, adjusted, disassembled for repair and/or replacement of components, reassembled and readjusted without use of sophisticated machinery or tooling. Further, as illustrated, the acoustic radiating means that is subject to flexing or bending which aids in generation of the generated wave of energy in the transmitting medium may include a flat plate, or be readily fabricated therefrom, or may include some other readily obtainable shape, such as an H- or I-bar member for ease of manufacture.

For example, during assembly of transducer assembly 10 (FIG. 1), nodal ring 40 may be secured to one plate 20 by joining means 42 and electronic components or other items may be disposed in the center of transducer 10 as desired. Purchase means 66 of one end of each of driver means 30 and 50 may then be assembled to cooperate with driver support means 60 of one disk 20. The other disk 20 may then be arranged to engage nodal ring 40 with its set of driver support means 60 cooperating with purchase means 66 that are connected to the other end of driver means 30 and 50. Joining means 42 may then secure the second assembled disk 20 to nodal ring 40.

Driver mounting means 60 may be adjusted, such as by torquing to a predetermined value when mounting means 60 include a threaded member. Appropriate electrical or other connections may be communicated to the interior of assembly 10 through a sealable hole for example, in cover 45, and transducer 10 may be tested for desired waveform generation.

During waveform generation testing, the torque on each of mounting means 60 may be individually independently increased or decreased for achieving the desired waveform. Not only is this a relatively simple way of tuning transducer 10, but it permits mounting means 60 to accommodate a differences in length between or among driver means 30 and 50, thereby foregoing the potentially expensive requirement that the longitudinal extent of each of driver means 30 and 50 be exactly the same, or have a length controlled to a very tight tolerance. Adjustment of mounting means 60 also facilitates fabrication and stocking of spare parts, and especially driver means 30 and/or 50 which do not need to be closely size matched to existing ones of the transducer.

Disassembly of transducer 10 may be effected by reversing the steps of assembly. Not only does this permit easy removal and replacement of components, such as driver means 30 and 50, as may be required or desired, but after reassembly, and especially in the case of replacement of only some of driver means 30 and/or 50, realignment can be performed simply by re-torquing, retesting and readjusting torque as necessary to obtain the desired generated waveform.

For all other embodiments of transducer assemblies in accordance with the present invention, the transducer may be likewise readily assembled, tested, readjusted if necessary, with the steps reversed for component repair and/or replacement.

Thus has been illustrated and described a transducer having electroactive, or other, driver means for generating acoustic energy, wherein the electroactive, or other, driver means are not either part of, or rigidly connected to acoustic radiating means of the transducer, so that flexing forces and/or bending stressing to which the electroactive, or other, driver means may be subjected are substantially reduced and/or eliminated. Also shown and described is a transducer having acoustic radiating means including a flat member for generating acoustic energy, wherein the transducer and components thereof can be readily assembled/disassembled, repaired and/or replaced, especially as applied to components of the entire electroactive, or other, driver means, without need for special or sophisticated tooling or alignment procedures.

While only certain preferred features of the invention have been shown by way of illustration, many modifications and changes will occur to those skilled in the art. It is to be understood that the appended claims are intended to cover all such modifications and changes as fall within the true spirit and scope of the invention.

What is claimed is:

1. In an acoustic transducer having driver means for urging acoustic energy from the transducer, support apparatus for reducing predetermined stress on the driver means, the apparatus comprising:

driver mounting means; and purchase means for connecting to the acoustic driver means and for pivotally connecting to the driver mounting means such that pivoting of the purchase means with respect to the driver mounting means reduces bending stress on the transducer while urging acoustic energy from the transducer.

2. The apparatus as in claim 1, wherein the driver mounting means include a member having a portion with a first predetermined contour and the purchase means include recess means having a second predetermined contour, the second predetermined contour complementary to the first predetermined contour and the recess means for receiving the portion of the member.

3. The apparatus as in claim 2, wherein the first predetermined contour is selected from the group consisting of spherical, oval, elliptical and conical.

4. The apparatus as in claim 1, further including lubricant disposed between the driver mounting means and the purchase means.

5. The apparatus as in claim 1, wherein the driver mounting means include a screw having a head at one end and the other end for pivotally connecting to the purchase means.

6. The apparatus as in claim 2, wherein the member includes a screw having a head at one end and the other end having the first predetermined contour.

7. The apparatus as in claim 1, wherein the purchase means include recess means having a first predetermined contour and further wherein the driver mounting means include:

engaging block means having a recess with a second predetermined contour, the second predetermined contour registrable with the recess means;

screw means for urging the engaging block means toward the purchase means; and separation means disposed in the recess means and recess of the engaging block means, the separation means for maintaining separation between the engaging block means and purchase means while permitting pivoting of the purchase means with respect to the driver mounting means.

8. The apparatus as in claim 7, wherein the first and second contour include a conical contour and further wherein the separation means include a spheroid.

9. The apparatus as in claim 7 wherein the separation means include a sphere.

10. A transducer assembly comprising:

acoustic radiating means for generating energy in a transmitting medium; and driver means for urging the radiating means to generate the acoustic energy, the driver means pivotally coupled to the acoustic radiating means for relieving bending stress on the driver means while urging the radiating means to generate the acoustic energy.

11. The assembly as in claim 10, wherein the driver means include an electroactive material.

12. The assembly as in claim 11 wherein the electroactive material is selected from the group consisting of piezoelectric ceramic, electrostrictive ceramic, magnetostrictive nickel, rare earth magnetic materials and combinations thereof.

13. The assembly as in claim 11, wherein the electroactive material includes an elongated member.

14. The assembly as in claim 13, wherein the elongated member includes a plurality of segments of the electroactive material, the segments being connected for forming at least a portion of the elongated member.

15. The assembly as in claim 10, wherein the acoustic radiating means include a disk.

16. The assembly as in claim 10, wherein the acoustic radiating means include an I-shaped member and the driver means is pivotally coupled to a leg of the I-shaped member.

17. The assembly as in claim 10, wherein the acoustic radiating means includes a pair of spaced apart disks and the driver means pivotally coupled to each disk.

18. The assembly as in claim 15, further including first and second driver means respectively disposed on each side of a major plane through the disk, the first and second driver means operational out of phase with respect to each other for urging the disk to flex in a direction transverse the major plane of the disk for generating the acoustic energy.

19. The assembly as in claim 18, wherein the first and second drive means include a respective elongated member having a longitudinal axis, the respective elongated member disposed so that the longitudinal axis is substantially parallel to a major plane through the disk.

20. The assembly as in claim 15, wherein the driver means include an elongated member having a longitudinal axis, the elongated member disposed so that the longitudinal axis is substantially parallel to a major plane of the disk, the driver means for urging the disk to flex in a direction transverse the major plane of the disk for generating the acoustic energy.

21. The assembly as in claim 10, wherein the acoustic radiating means include a flat member.

22. The assembly as in claim 21, wherein the member is selected from the group consisting of a bar, a plate, a disk and combinations thereof.

23. A transducer assembly for generating acoustic energy in a medium, comprising:

first and second spaced apart acoustic radiating means;

a member having a first and second side and further having a first and second portion of the member respectively rigidly connected to the first and second radiating means;

a first plurality of driver means disposed on the first side of the member and having a first portion pivotally connected to the first radiating means and a second portion pivotally connected to the second radiating means; and a second plurality of driver means disposed on the second side of the member and having a first portion pivotally connected to the first radiating means and a second portion pivotally connected to the second radiating means, wherein the first and second driver means for cooperating to urge movement of the first and second radiating means when the first and second driver means are subjected to an electroactive means for causing a physical change in the first and second driver means, such movement for generating the energy in the medium while predetermined stress on the first and second driver means is relieved when the first and second driver means pivot with respect to the first and second radiating means.

24. The assembly as in claim 23, wherein the first driver means include an electroactive material.

25. The assembly as in claim 24, wherein the electroactive material is selected from the group consisting of piezoelectric ceramic, electrostrictive ceramic, magnetostrictive nickel, rare earth magnetic materials and combinations thereof.

26. The assembly as in claim 24, wherein the first and second radiating means include respective first and second flat substantially parallelly disposed elements.

27. The assembly as in claim 26, wherein the first plurality of driver means are circumferentially spaced apart from each other, the second plurality of driver means are circumferentially spaced apart from each other and the member includes a hollow cylinder disposed between the first and second plurality of driver means.

28. The assembly as in claim 23, further including driver mounting means coupled to the first radiating means for pivotally connecting the first driver means to the first radiating means.

29. The assembly as in claim 28, wherein the driver support means is adjustable for exerting a predetermined force on the first driver means.

30. The assembly as in claim 23, wherein one of the first and one of the second plurality of driver means are disposed to cooperate as an opposing pair so that physical changes of the one of the first and of the one of the second plurality of driver means are out of phase with each other.

31. A method for generating a wave of energy in a transmitting medium, comprising:

subjecting a first member to an electroactive phenomenon having a first orientation for causing a first change in a physical dimension of the first member in a first direction;

subjecting the first member to an electroactive phenomenon having a second orientation for causing a second change in the physical dimension of the first member in a second direction, the second direction being different from the first direction;

pivotally connecting the first member to a second member such that the first change and second change urge movement of the second member in the first and second direction, respectively, wherein movement of the second member for generating the energy; and pivoting the first member with respect to the second member for relieving bending stress in the first member while generating the wave of energy.

32. The method as in claim 31, wherein the step of pivotally connecting includes connecting the first member to the second member by a sphere, such that pivoting of the first member with respect to the second member is accommodated by the sphere.

33. The method as in claim 31, wherein the first and second directions are opposite each other.

34. The method as in claim 31, wherein both subjecting steps are alternately repeated for obtaining oscillating movement of the second member.

* * * * *